US007857050B2

(12) United States Patent
Zazovsky et al.

(10) Patent No.: US 7,857,050 B2
(45) Date of Patent: Dec. 28, 2010

(54) FLOW CONTROL USING A TORTUOUS PATH

(75) Inventors: Alexander F. Zazovsky, Houston, TX (US); Mark H. Fraker, Houston, TX (US); Qing Yao, Pearland, TX (US); Adinathan Venkitaraman, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 549 days.

(21) Appl. No.: 11/643,104

(22) Filed: Dec. 21, 2006

(65) Prior Publication Data

US 2007/0272408 A1 Nov. 29, 2007

Related U.S. Application Data

(60) Provisional application No. 60/803,253, filed on May 26, 2006.

(51) Int. Cl.
*E21B 43/04* (2006.01)
*E03B 3/18* (2006.01)

(52) U.S. Cl. ..... 166/278; 166/227; 166/319; 166/375; 166/386

(58) Field of Classification Search ..... 166/227, 166/278, 319, 375, 386
See application file for complete search history.

(56) References Cited

U.S. PATENT DOCUMENTS

| | | | |
|---|---|---|---|
| 2,837,032 | A | 6/1958 | Horsting, Sr. |
| 3,323,550 | A | 6/1967 | Lee |
| 4,237,978 | A | 12/1980 | Calderon |
| 4,951,753 | A | 8/1990 | Eriksen |
| 5,269,376 | A | 12/1993 | Gadelle et al. |
| 5,307,984 | A | 5/1994 | Nagaoka |
| 5,316,081 | A | 5/1994 | Baski |
| 5,355,953 | A | 10/1994 | Shy et al. |
| 5,435,393 | A | 7/1995 | Brekke et al. |
| 5,730,223 | A | 3/1998 | Restarick |
| 5,803,179 | A | 9/1998 | Echols et al. |
| 5,881,809 | A | 3/1999 | Gillespie et al. |
| 5,896,928 | A | 4/1999 | Coon |
| 5,906,238 | A | 5/1999 | Carmody et al. |
| 6,030,332 | A | 2/2000 | Hensley |

(Continued)

FOREIGN PATENT DOCUMENTS

| | | |
|---|---|---|
| EP | 0 588 421 | 9/1993 |

(Continued)

OTHER PUBLICATIONS

C. Atkinson, et al. "Flow Performance of Horizontal Wells with Inflow Control Devices", European Journal of Applied Mathematics, vol. 15, issue 04, pp. 409-450 (Aug. 2004).

(Continued)

*Primary Examiner*—Kenneth Thompson
*Assistant Examiner*—Yong-Suk Ro

(57) ABSTRACT

An apparatus for use in a wellbore includes a flow conduit and a structure defining a tortuous fluid path proximate the flow conduit, where the tortuous fluid path receives a flow of fluid. The tortuous fluid path is defined by at least first and second members of the structure, and the first and second members are movable with respect to each other to adjust a cross-sectional flow area of the tortuous fluid path.

20 Claims, 8 Drawing Sheets

U.S. PATENT DOCUMENTS

| | | | | |
|---|---|---|---|---|
| 6,112,815 | A | 9/2000 | Bøe et al. | |
| 6,112,817 | A | 9/2000 | Voll et al. | |
| 6,276,458 | B1 | 8/2001 | Malone et al. | |
| 6,289,986 | B1 | 9/2001 | Wright | |
| 6,343,651 | B1 | 2/2002 | Bixenman | |
| 6,371,210 | B1 | 4/2002 | Bode et al. | |
| 6,529,107 | B2 | 3/2003 | Shimizu | |
| 6,533,038 | B2 | 3/2003 | Venning et al. | |
| 6,622,794 | B2 | 9/2003 | Zisk, Jr. | |
| 6,644,412 | B2 | 11/2003 | Bode et al. | |
| 6,672,385 | B2 | 1/2004 | Kilaas | |
| 6,745,843 | B2 | 6/2004 | Johnson et al. | |
| 6,786,285 | B2 | 9/2004 | Oddie et al. | |
| 6,851,560 | B2 | 2/2005 | Reig et al. | |
| 6,857,475 | B2 | 2/2005 | Johnson | |
| 6,857,575 | B2 | 2/2005 | Mathias et al. | |
| 6,883,613 | B2 | 4/2005 | Bode et al. | |
| 6,899,176 | B2 | 5/2005 | Hailey, Jr. et al. | |
| 7,013,979 | B2 | 3/2006 | Richard | |
| 7,077,200 | B1 | 7/2006 | Adnan | |
| 7,228,912 | B2 | 6/2007 | Patel | |
| 7,234,518 | B2 | 6/2007 | Smith | |
| 7,258,166 | B2 | 8/2007 | Russell | |
| 7,413,022 | B2 * | 8/2008 | Broome et al. | 166/386 |
| 7,469,743 | B2 | 12/2008 | Richards | |
| 7,673,678 | B2 | 3/2010 | MacDougall | |
| 7,729,756 | B2 | 6/2010 | Mertelmeier | |
| 2004/0018839 | A1 | 1/2004 | Andric | |
| 2004/0020832 | A1 * | 2/2004 | Richards et al. | 210/106 |
| 2004/0035591 | A1 | 2/2004 | Echols | |
| 2006/0157257 | A1 | 7/2006 | Ross | |
| 2007/0272408 | A1 | 11/2007 | Zazovsky | |
| 2008/0041588 | A1 | 2/2008 | Richards | |

FOREIGN PATENT DOCUMENTS

| | | | |
|---|---|---|---|
| GB | 2376970 | A | 12/2002 |
| WO | 97/16623 | A1 | 5/1997 |
| WO | WO 02/075110 | | 9/2002 |
| WO | WO 03/023185 | | 3/2003 |
| WO | 03072907 | A1 | 9/2003 |
| WO | WO 2004/018839 | | 3/2004 |
| WO | WO 2004/113671 | | 12/2004 |
| WO | 2005080750 | A1 | 9/2005 |

OTHER PUBLICATIONS

"Equalizer™ Production Enhancement System", Baker Oil Tools, Baker Hughes Inc., Pub. No. BOT-04-7761 4M (Jun. 2005).

"Application Answers: Combating Coning by Creating Even Flow Distribution in Horizontal Sand-Control Completions", Weatherford International Ltd. (2005).

Ben J. Dikken, "Pressure Drop in Horizontal Wells and Its Effect on Production Performance", SPE 19824, pp. 1426-1433, pp. 569-574, Society of Petroleum Engineers (Nov. 1990).

M.J. Landman, et al., "Optimization of Perforation Distribution for Horizontal Wells", SPE 23005, pp. 567-576, Society of Petroleum Engineers (1991).

A.N. Folefac, et al., "Effect of Pressure Drop Along Horizontal Wellbores on Well Performance", SPE 23094, pp. 549-560, Society of Petroleum Engineers (1991).

B.P. Marrett, et al., "Optimal Perforation Design for Horizontal Wells in Reservoirs with Boundaries", SPE 25366, pp. 397-406, Society of Petroleum Engineers (1993).

Kristian Brekke, et al., "A New Modular Approach to Comprehensive Simulation of Horizontal Wells", SPE 26518, pp. 109-123, Society of Petroleum Engineers (1993).

Fikri J. Kuchuk, et al., "Performance Evaluation of Horizontal Wells", SPE 39749, pp. 231-243, Society of Petroleum Engineers (1998).

Hong Yuan, et al., "Effect of Completion Geometry and Phasing on Single-Phase Liquid Flow Behavior in Horizontal Wells", SPE 48937, pp. 93-104, Society of Petroleum Engineers (1998).

Yula Tang, et al., "Performance of Horizontal Wells Completed with Slotted Liners and Perforations", SPE 65516, pp. 1-15, Society of Petroleum Engineers/PS-CIM International Conference on Horizontal Well Technology (1991).

Terje Moen, et al., "A New Sand Screen Concept. No Longer the Weakest Link of the Completion String", SPE 68937, pp. 1-10, Society of Petroleum Engineers (2001).

Jody R. Augustine, "An Investigation of the Economic Benefit of Inflow Control Devices on Horizontal Well Completions Using a Reservoir-Wellbore Coupled Model", SPE 78293, pp. 1-10, Society of Petroleum Engineers (2002).

D.S. Qudaihy, et al., "New-Technology Application to Extend the life of Horizontal Wells by Creating Uniform-Flow-Profiles: Production Completion System: Case Study", SPE/IADC 85332, pp. 1-5, Society of Petroleum Engineers/International Association of Drilling Contractors (2003).

K.H. Henriksen, et al., "Integration of New Open Hole Zonal Isolation Technology Contributes to Improved Reserve Recovery and Revision in Industry Best Practices", SPE 97614, pp. 1-6, Society of Petroleum Engineers (2005).

J.C. Moreno, et al., "Optimized Workflow for Designing Complex Wells", SPE 99999, pp. 1-8, Society of Petroleum Engineers (2006).

Sada D. Joshi, *Horizontal Well Technology*, Chapter 10, "Pressure Drop Through a Horizontal Well", pp. 379-382, 388-396, 404-407, 412-414, PennWell Books, PennWell Publishing Co., Tulsa, OK (1991).

ResFlow,Reslink, http://www.reslink.com/products3.html (2003).

ResFlow: Well Production Management System, Reslink (2005).

Equalizer Production Management System, Baker-Hughes, Baker Oil Tools (nd).

Cameron White, et al., "Controlling Flow in Horizontal Wells", World Oil, pp. 73-80 (Nov. 1991).

U.S. Appl. No. 11/765,932, Non-Final Rejection mailed on Jul. 13, 2009, pp. 1-5 and attachments.

U.S. Appl. No. 11/765,932, Notice of Allowance mailed on Dec. 18, 2009 (7 pages).

U.S. Appl. No. 11/765,932, Notice of Allowance mailed on Apr. 13, 2010 (4 pages).

* cited by examiner

FLOW CONTROL USING A TORTUOUS PATH

CROSS-REFERENCE TO RELATED APPLICATION

This claims the benefit under 35 U.S.C. §119(e) of U.S. Provisional Application Ser. No. 60/803,253, entitled "Device for Creating a Pressure Drop for Controlling Flow Along a Wellbore," filed May 26, 2006.

TECHNICAL FIELD

This invention relates generally to flow control using a tortuous path, in which a cross-sectional flow area of the tortuous path is adjusted to control flow.

BACKGROUND

A well (e.g., a vertical well, near-vertical well, deviated well, horizontal well, or multi-lateral well) can pass through various hydrocarbon bearing reservoirs or may extend through a single reservoir for a relatively long distance. A technique to increase the production of the well is to perforate the well in a number of different zones, either in the same hydrocarbon bearing reservoir or in different hydrocarbon bearing reservoirs.

An issue associated with producing from a well in multiple zones relates to the control of the flow of fluids into the well. In a well producing from a number of separate zones, in which one zone has a higher pressure than another zone, the higher pressure zone may produce into the lower pressure zone rather than to the surface. Similarly, in a horizontal well that extends through a single reservoir, zones near the "heel" of the well (the zones nearer the surface) may begin to produce unwanted water or gas (referred to as water or gas coning) before those zones near the "toe" of the well (the zones further away from the earth surface). Production of unwanted water or gas in any one of these zones may require special interventions to be performed to stop production of the unwanted water or gas.

In other scenarios, certain zones of the well may have excessive drawdown pressures, which can lead to early erosion of devices or other problems.

To address coning effects or other issues noted above, flow control devices are placed into the well. There are various different types of flow control devices that have conventionally been used to equalize flow rates (or drawdown pressures) in different zones of a well. Some conventional flow control devices employed tortuous paths to provide a flow restriction before fluid is allowed to enter a flow conduit from the surrounding reservoir(s). However, such flow control devices generally suffer from lack of flexibility and/or are relatively complex in design.

SUMMARY

In general, according to an embodiment, an apparatus for use in a wellbore comprises a flow conduit, and a structure defining a tortuous fluid path proximate the flow conduit. The tortuous fluid path receives a flow of fluid, and is defined by at least first and second members of the structure. The first and second members are movable with respect to each other to adjust a cross-sectional flow area of the tortuous fluid path.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
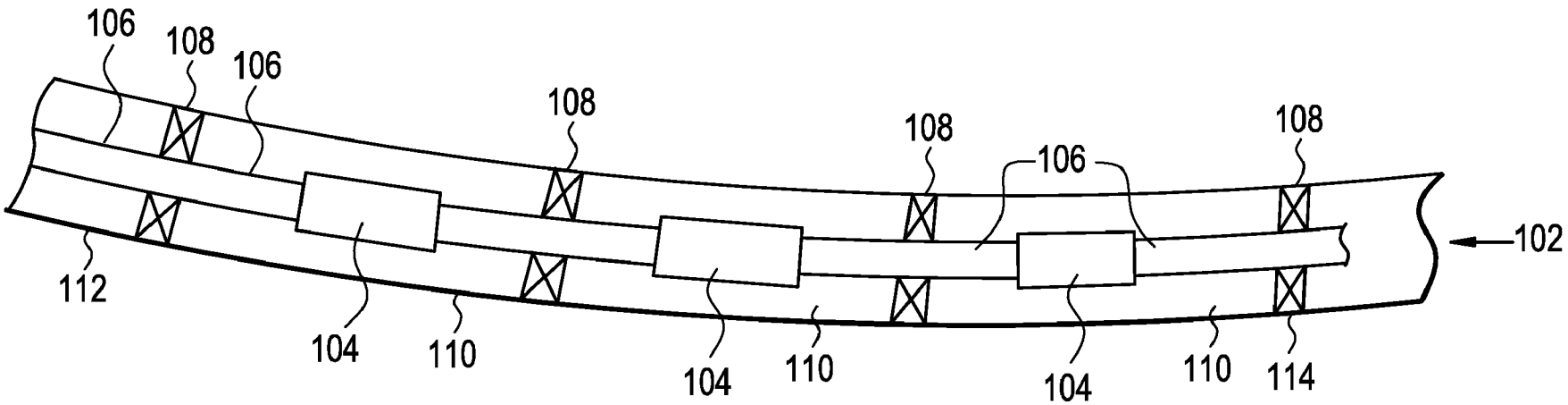
FIG. 1 illustrates an example arrangement of a completion system that incorporates flow control devices according to some embodiments.

FIG. 1 illustrates an example completion system installed in a horizontal or substantially horizontal wellbore 102 where the completion system includes multiple flow control devices 104 in accordance with some embodiments. Although the wellbore 102 is depicted as being a horizontal or substantially horizontal wellbore, the flow control devices according to some embodiments can be used in vertical or deviated wellbores in other implementations. The flow control devices 104 are connected to a tubing or pipe 106 (more generally referred to as a "flow conduit") that can extend to the earth surface or to some other location in the wellbore 102. Also, sealing elements 108 (e.g., packers) are provided to define different zones 110 in the wellbore 102.

The different zones 110 correspond to different fluid flow zones, where fluid flow in each zone 110 is controlled by a respective flow control device 104.

In a production context, fluid flows from a surrounding reservoir (or reservoirs) into the wellbore 102, with the flow control devices 104 controlling the flow of such incoming fluids (which can be hydrocarbons) into the pipe 106. On the other hand, in the injection context, the flow control devices 104 control injection of fluid from inside the pipe 106 out towards the surrounding formation.

An issue associated with producing or injecting fluids in a well having multiple zones, such as the wellbore 102 depicted in FIG. 1, is the lack of control over the local drawdown pressures in the different zones. The horizontal or substantially horizontal wellbore 102 has a heel 112 (which is a section of the wellbore closer to the earth surface) and a toe 114 (which is a section of the wellbore further away from the earth surface). During production, the local drawdown pressure at the heel 112 tends to be larger than the local drawdown pressure at the toe 114, which can result in a greater flow rate at the heel 112 than at the toe 114. The frictional pressure drop caused by flow of fluids (injection fluids or production fluids) in a flow conduit (production or injection conduit) contributes to the variation of local drawdown pressure. As a result of the different local drawdown pressures in the different zones, hydrocarbons in the reservoir portion proximate the heel 112 are prone to depleting at a faster rate than hydrocarbons in the reservoir portion proximate the toe 114. This can result in an undesirable production profile across the entire well which might lead to the production of unwanted water or gas into the wellbore zone proximate the heel 112 (an effect referred to as water or gas coning).

To control the production profile (by controlling the local drawdown pressures and flow rates into the different zones 110 of the wellbore 102), the flow control devices 104 are provided. Note that water or gas coning is just one of the adverse effects that can result from uncontrolled drawdown pressures in different zones. Other possible adverse effects include excessive erosion of equipment in zones with larger drawdown pressures, cave-in in a zone having a large drawdown pressure, and others.

Although reference is made to production of fluids, it is noted that flow control is also desirable in the injection context.

Each flow control device 104 in accordance with some embodiments defines a tortuous path through which fluid flows between the inside and outside of the flow control device 104. A tortuous path is a path having multiple twists, bends, or turns. The tortuous path is defined proximate a pipe (or other type of flow conduit) of the flow control device. For example, the tortuous path can be provided around the outer surface of the pipe.

To provide selective drawdown pressure and flow rate control in the tortuous path of each flow control device 104, an adjustment mechanism is provided to adjust the cross-sectional flow area of the tortuous path of the corresponding flow control device. The cross-sectional flow area is the flow area available for fluid flow through the tortuous path. A change in flow restriction across the flow control device is related to the change in cross-sectional flow area. Therefore, the ability to adjust the cross-sectional flow area allows a well operator to control the flow restriction across the flow control device (and thus the local drawdown pressure and flow rate of the flow control device).

In accordance of some embodiments of the invention, the cross-sectional flow area of the flow control device is adjustable at any one of more of the following locations: at the assembly site, at the well site, or in a downhole location (using either an intervention mechanism or intervention-less mechanism). An intervention mechanism to adjust the cross-sectional flow area of a tortuous path in a flow control device while the flow control device is downhole includes an intervention tool that is run into the wellbore to engage and to actuate the adjustment mechanism of a flow control device that controls the available cross-sectional flow area of the tortuous path. An intervention-less mechanism refers to a mechanism that allows remote actuation of the flow control devices (either by electrical signaling, hydraulic signaling, optical signaling, and so forth) to control the cross-sectional flow areas of the flow control devices.

In one embodiment, the tortuous path of a flow control device is defined by a compressible component, such as a helical structure that is generally shaped like a coil spring. The compressible component can be compressed or uncompressed to adjust the cross-sectional flow area of the tortuous path defined by the compressible member.

Alternatively, instead of using a compressible element, the flow control device can include other types of members for defining tortuous paths, where at least one or more of the members are movable to adjust the cross-sectional flow area of the tortuous path. Generally, an adjustment mechanism for adjusting a cross-sectional flow area of a tortuous path in a flow control device includes at least two members that are movable with respect to each other to adjust the cross-sectional flow area. In the example where the adjustment mechanism includes a helical structure, the at least two members include different portions of the helical structure. Various different types of adjustment mechanisms for defining tortuous paths in flow control devices are discussed below.

Figure 2A:
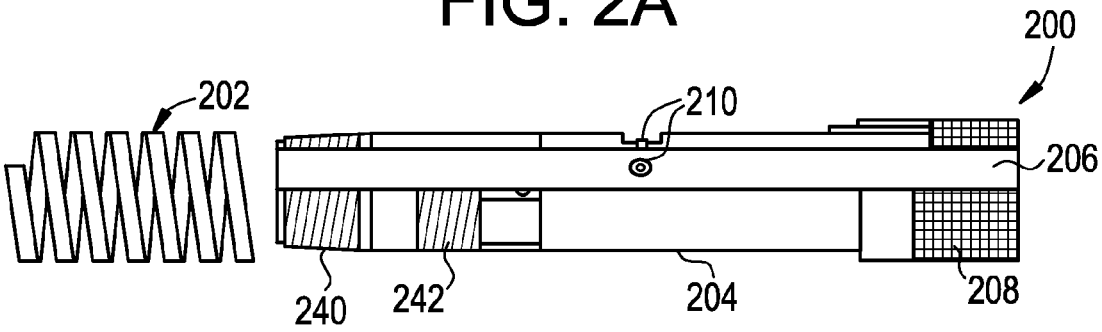
FIGS. 2A-2D illustrate a portion of a flow control device, according to an embodiment having a helical structure for defining a tortuous path having an adjustable cross-sectional flow area, that is usable in the completion system of FIG. 1.

FIGS. 2A-2D illustrate one example adjustment mechanism for defining a tortuous path of a flow control device, where the adjustment mechanism includes a helical structure 202 (e.g., a helical wire, a coil spring, etc.) that is fittable over a section of a base pipe 204 of a flow control device 200. FIG. 2A depicts a partially cut-away view of the flow control device 200 to show an inner bore 206 of the flow control device 200. The flow control device 200 also includes a sand screen 208 provided around another section of the pipe 204. The sand screen 208 is used for filtering out sand particles or other particulates such that the sand particles or other particulates do not flow into the inner bore 206 of the pipe 204.

Ports 210 are provided on the pipe 204 to allow flow from an annulus region (defined between the outside of the flow control device 200 and the wall of the wellbore) into the inner bore 206 of the pipe 204. The pipe 204 also has two sets of threads, including a first set 240 and a second set 242. The first set 240 of threads is used to threadably connect the flow control device 200 to another downhole component in a tool string. The second set 242 of threads is used to allow threaded rotation of a collar 222 (FIG. 2C) for adjusting compression or decompression of the helical structure 202.

Figure 2B:
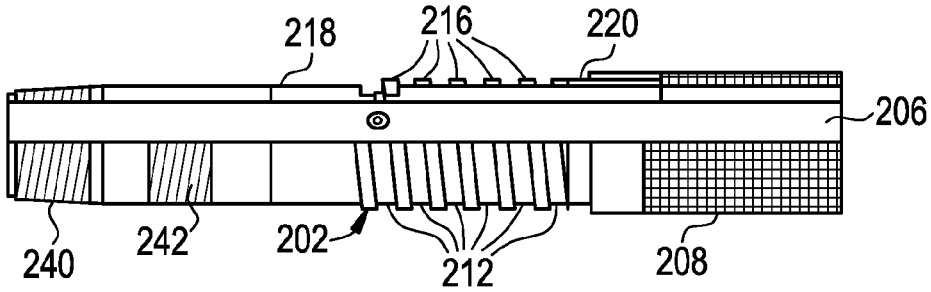

FIG. 2B shows the helical structure 202 mounted onto the pipe 204 such that a spiral path 212 is defined around the outer surface of the pipe 204. The spiral path 212 is a form of tortuous path.

The helical structure 202 has a tight fit with respect to the outer surface of the pipe 204 such that a reduced amount of leakage (or no leakage) occurs between different turns of the spiral path 212. In other implementations, sealing elements are provided to provide a fluid tight seal between the helical structure 202 and the pipe to prevent fluid leakage. Various forms of these sealing elements are described further below.

Figure 2C:
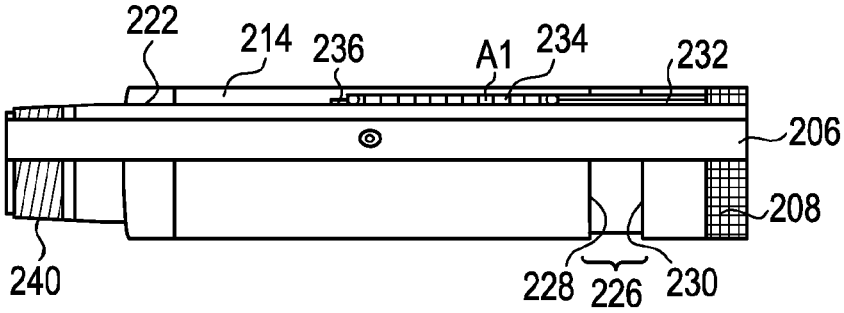

FIG. 2C depicts an outer sleeve (or outer cover) 214 to cover the helical structure 202 as well as portions of the pipe 204. The outer sleeve 214 is provided over and contacted to the outer surface 218 (FIG. 2B) of a lower portion of the pipe 204, the outer surface 216 of the helical structure 202, and an outer surface 220 of another portion of the pipe 204. The outer sleeve 214 is sealingly engaged to the outer surfaces 218 and 220 of the different portions of the pipe 204, such as by use of elastomeric O-ring seals.

FIG. 2C also shows the collar 222 provided on one end of the outer sleeve 214. As better depicted in FIG. 2D, the collar 222 is threadably connected to the set 242 of threads of the pipe 204 to allow axial movement of the collar 222 (movement in the direction of the longitudinal axis of the pipe 204) when the collar 222 is turned. Axial movement of the collar 222 also causes a corresponding axial movement of the outer sleeve 214. The collar 222 and outer sleeve 214 are initially at a first position (FIG. 2C), in which the helical structure 202 is in a relaxed position (uncompressed position). Note that, in the first position, a gap 226 is provided between the other end 228 of the outer sleeve 218 and a flanged structure 230 provided on the pipe 204. The gap 226 is provided to enable movement of the outer sleeve 214 toward the flanged structure 230 on the pipe 204.

Figure 2D:
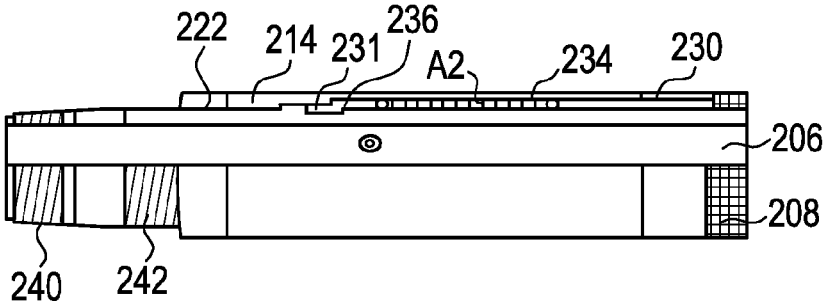

Thus, as depicted in FIG. 2D, rotation of the collar 222 has caused axial movement of the outer sleeve 214 such that the outer sleeve 214 has traversed across the gap 226 to abut the flanged structure 230. In the position of FIG. 2D (the final position), the helical structure 202 has been compressed such that the cross-sectional flow area of the spiral path 212 defined by the helical structure 202 is reduced. Note that there are various intermediate positions of the collar 222 and outer sleeve 214 that correspond to respective different compressed states of the helical structure 202. The continuous movement of the collar 222 allows for continuous adjustment of the compression state of the helical structure 202, and therefore the continuous adjustment of the cross-sectional flow area of the tortuous path defined by the helical structure 202.

In other implementations, other mechanisms for compressing or uncompressing the helical structure 202 can be used, where such mechanisms generally include a movable component that is translatable with respect to the helical structure 202 to compress or uncompress the helical structure 202. The movable component can be moved to multiple positions to correspond to multiple compression states of the helical structure 202.

As depicted in FIG. 2C, the cross-sectional flow area of the spiral path 212 is A1 when the helical structure 202 is in a relaxed (uncompressed) position. However, as depicted in FIG. 2D, the cross-sectional area of the spiral path 212 is A2 after compression of the helical structure 202, where A2 is less than A1. Due to the reduction in cross-sectional flow area of the spiral path 212 in FIG. 2D, the flow restriction of the tortuous path is increased. Note that although the cross-sectional flow area of the spiral path 212 has been changed, the overall length of the spiral path 212 remains the same.

The collar 222 can be manually rotated by a user, such as at an assembly site or at the wellsite. If adjustment of the collar 222 is desirable while the flow control device 200 is located downhole, then a mechanism can be added to the flow control device 200 to allow for mechanical, electrical, or hydraulic actuation of the collar 222. The mechanical, electrical, or hydraulic actuation can be performed with or without an intervention tool.

In operation, in the production context, fluid flows from the well annulus (outside the flow control device 200) through the sand screen 208 into an annular flow path 232 inside the sand screen 208 (FIG. 2C). The fluid flows through the annular flow path 232 into a first end 234 of the spiral path 212. The fluid follows the spiral path 212 until the fluid exits the second end 236 of the spiral path 212, where the fluid is allowed to flow through the ports 210 on the pipe 204 into the inner bore 206 of the pipe 204.

In the FIG. 2D position, where the helical structure 202 has been compressed, the fluid exiting the second end 236 of the spiral path 212 flows into another annular region 231 before the fluid reaches the ports 210 to allow entry into the inner bore 206 of the pipe 204.

The flow path is reversed in the injection context, where fluid is injected from an upstream tubing (such as a tubing that extends to the earth surface) into the inner bore 206 of the flow control device 200. The injected fluid exits the ports 210 to then follow the spiral path 212 until it reaches the sand screen 208, at which point the fluid flows from the annular path 232 out of the sand screen 208 into the well annulus.

Figure 3A:
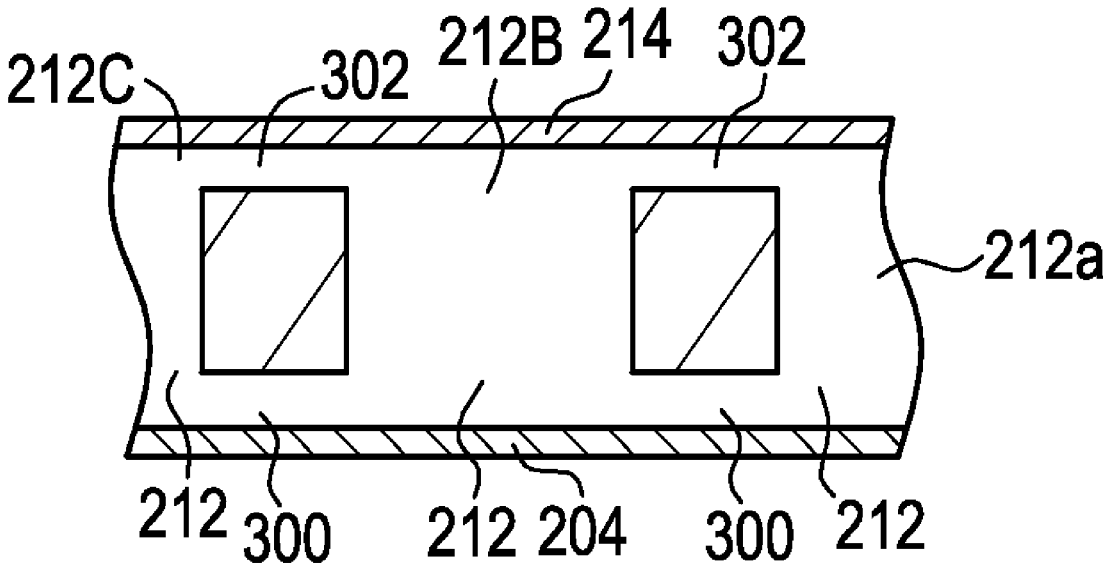
FIGS. 3A-3D illustrate various different types of solutions to allow a sealed fit between the helical structure used in the flow control device of FIGS. 2A-2D and other portions of the flow control device, according to an embodiment.
Figure 3B:
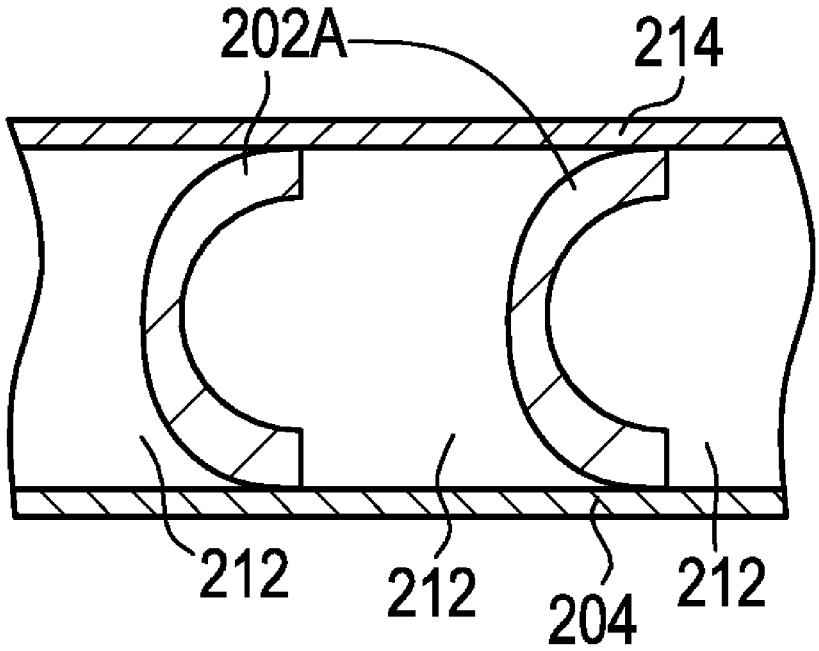

In some implementations, there may be an issue of leakage between the helical structure 202 and the pipe 204 and between the helical structure 202 and outer sleeve 214. As depicted in FIG. 3A, this leakage of fluid may occur through an annular clearance 300 between the helical structure 202 and the outer surface of the pipe 204, and through an annular clearance 302 between the helical structure 202 and the outer sleeve 214. The leakage occurs between different turns of the spiral path 212 (e.g., turns 212A, 212B, and 212C depicted in FIG. 3A). The clearances 300, 302 can be caused by a radial deformation of the helical structure 202, such as due to inexact manufacturing tolerances, worn-out parts, or just by deformation caused by compressing the helical structure 202. Each clearance 300, 302 provides a shortcut for fluid to bypass the spiral path 212, which can cause the flow restriction across the flow control device to be lower than expected. In a worst-case scenario, the leakage through annular clearances 300, 302 can bypass the tortuous path in the flow control device completely. To mitigate this issue, several possible measures can be taken. In one example, instead of using the generally rectangular cross-sectional profile of the helical structure 202 as shown in FIG. 3A, a different helical structure 202A can use a curved cross-sectional profile, as depicted in FIG. 3B. The curved profile depicted in FIG. 3B has a generally crescent shape such that elastic deformation of the helical structure 202 is possible to seal the clearances 300, 302.

In an alternative embodiment, rather than forming the helical structure 202 of a metal, the helical structure 202 can be formed of an elastomer material (e.g., rubber). The compressible nature of the elastomer material allows the helical structure 202 to maintain a seal against the pipe 204 and the outer sleeve 214 such that the clearances 300, 302 do not form.

Figure 3C:
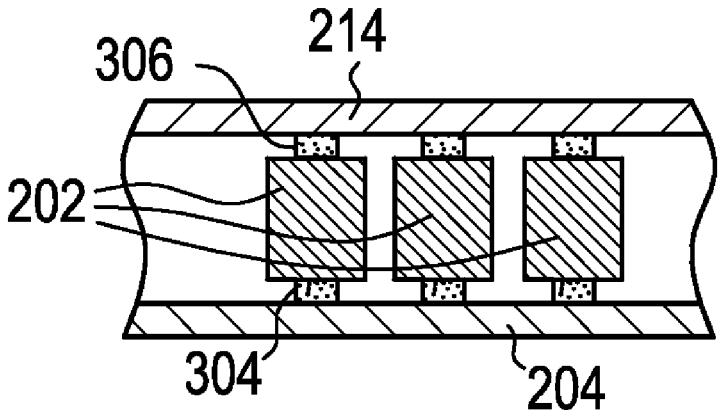

Another possible solution is depicted in FIG. 3C, where the helical structure 202 (which can be formed of metal, for example) is coated or otherwise covered with elastomer elements 304 and 306, where the elastomer elements 304 engage the pipe 204, and the elastomer elements 306 engage the outer sleeve 214. In this manner, the clearances 300 and 302 can be eliminated.

Figure 3D:
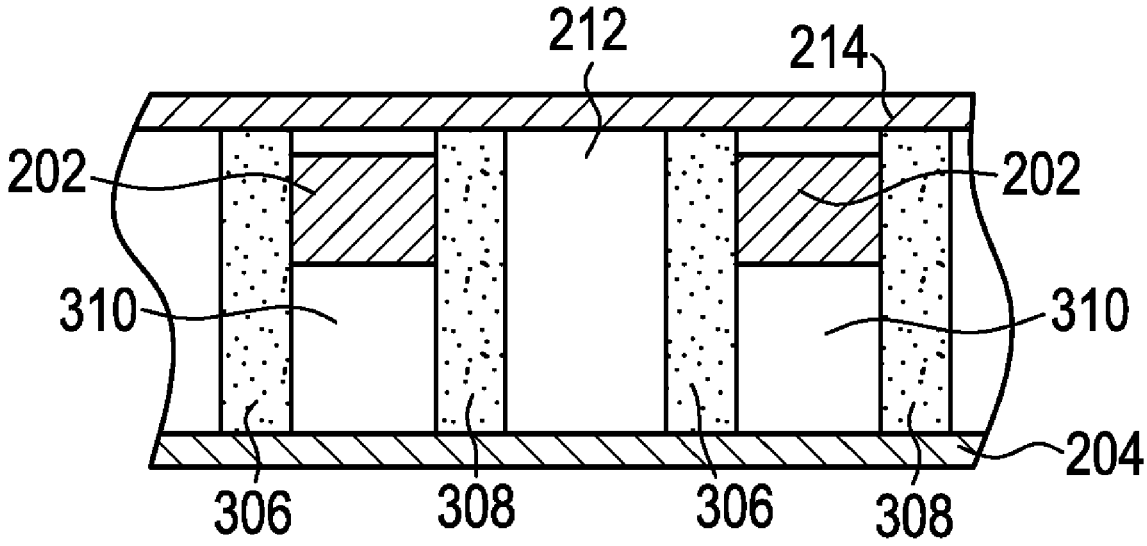

In another arrangement, as depicted in FIG. 3D, the helical structure 202 can be formed of a metal, except that the helical structure 202 is encased by elastomeric elements 306, 308 that sealingly engage both the outer cover 214 and the pipe 204. The elastomeric elements 306, 308 define an inner chamber 310 in which the helical structure 202 is movable during compression of the helical structure 202 or due to other causes. In this manner, the movement of the helical structure 202 does not cause creation of annular clearances 300, 302 that can lead to leakage. Note that the elastomeric elements 306, 308 and chamber 310 are also generally helically shaped.

Figure 4:
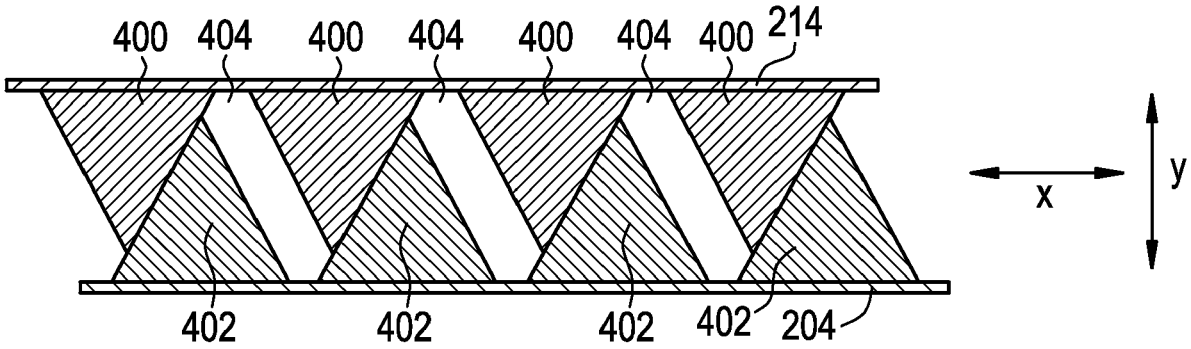
FIG. 4 illustrates a portion of a flow control device, according to another embodiment, having nested helical structures to provide a tortuous fluid path having an adjustable cross-sectional flow area.

FIG. 4 shows another type of an adjustment mechanism to provide a tortuous path that has an adjustable cross-sectional flow area. In FIG. 4, the assembly includes two nested helical structures 400 and 402 where the helical structure 400 is attached to the outer sleeve 214, and the helical structure 402 is attached to the pipe 204. The helical structures 400, 402 are movable with respect to each other both in an axial direction (indicated by direction x) and in the radial direction (indicated by directional y) of the pipe 204. The helical structures 400, 402 define a tortuous path 404 whose cross-sectional flow area changes due to relative movement of the helical structures 400, 402. In FIG. 4, each of the helical structures 400, 402 has a generally triangular cross-sectional profile. In FIG. 4, one of the triangles (corresponding to one helical structure) is upside down with respect to the other of the triangles (corresponding to the other helical structure) such that the slanted surface of one of the helical structures is engaged or mated to a corresponding slanted surface of the other helical structure. The engagement or mating of the slanted surfaces of the helical structures 400, 402 allows for motion in both the x and y directions, as depicted in FIG. 4, to change the cross-sectional flow area of the tortuous path 404.

Note that with the design provided in FIG. 4, the issue of annular clearances between the helical structures 400, 402 and the outer sleeve 214 and pipe 204 is reduced or eliminated.

Figure 5A:
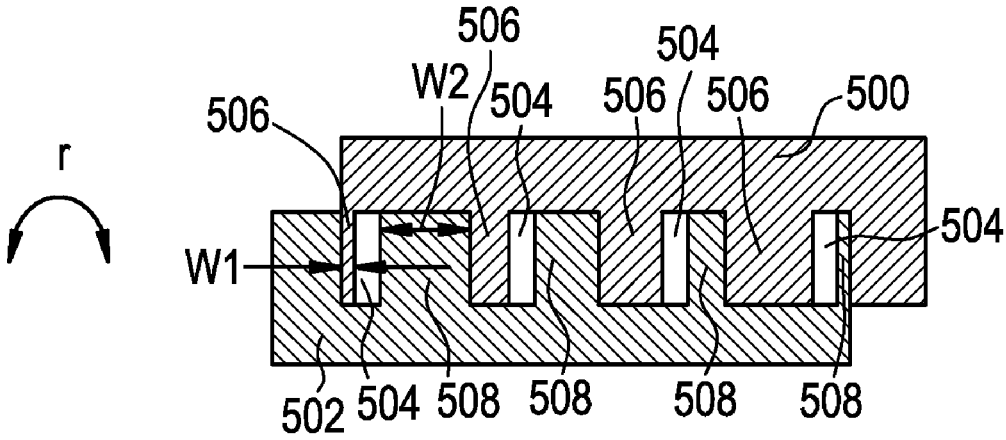
FIGS. 5A-5C illustrate corresponding portions of flow control devices, according to other embodiments, having members that are rotatable with respect to each other to provide tortuous fluid paths having adjustable cross-sectional flow areas.
Figure 5B:
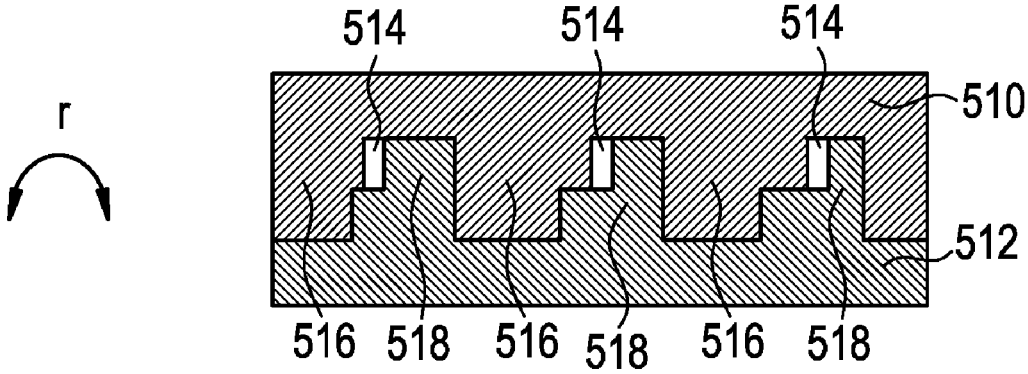
Figure 5C:
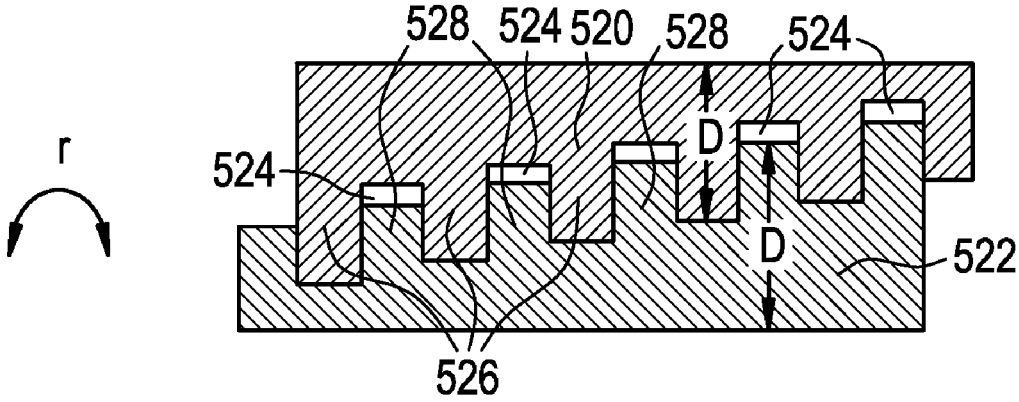

FIGS. 5A-5C illustrate adjustment mechanisms according to three alternative configurations where a tortuous path is defined by two members that are rotatable with respect to each other, such as rotation based on threaded engagement of the members. FIG. 5A shows an assembly having a first member 500 and a second member 502 that are threaded to each other to allow relative rotation or movement of the members 500 and 502 (in the rotational direction indicated by r). The member 500 has threads 506, while the member 502 has threads 508.

The two members 500 and 502 define a tortuous path 504. Relative rotation of the members 500 and 502 causes the cross-sectional flow area of the tortuous flow path 504 to change. In the FIG. 5A embodiment, the tooth width of threads of each of the members 500 and 502 varies. The tooth widths of the threads 506 on the member 500 are represented by W1, where W1 for each thread can be different. Similarly, the tooth widths for the threads 508 on the member 502 are represented by W2, where W2 for each thread on the member 502 can be different. In the FIG. 5A embodiment, the threads on the members 500 and 502 have constant pitch (the distance between two corresponding points on adjacent screw threads.).

FIG. 5B illustrates an adjustment mechanism according to a different embodiment, where the adjustment mechanism has a first member 510 and a second member 512 that are rotatable with respect to each other by a-threaded connection. The first member 510 has threads 516, and the second member 512 has threads 518. In the embodiment of FIG. 5B, the tooth widths of the threads of each of the members 510 and 512 vary, but the pitch of the threads on each of the members 510 and 512 is constant. The members 510, 512 define a tortuous path 514, whose cross-sectional flow area is changed by relative rotation of the first and second members 510, 512.

FIG. 5C shows another adjustment mechanism according to a different embodiment that has members 520 and 522 that are rotatable with respect to each other by a threaded connection. The members 520 and 522 define a tortuous path 524, whose cross-sectional flow area can change due to relative rotation of the members 520 and 522. The threads 526, 528 of each respective member 520, 522 has constant pitch but different diameters D.

Figure 6A:
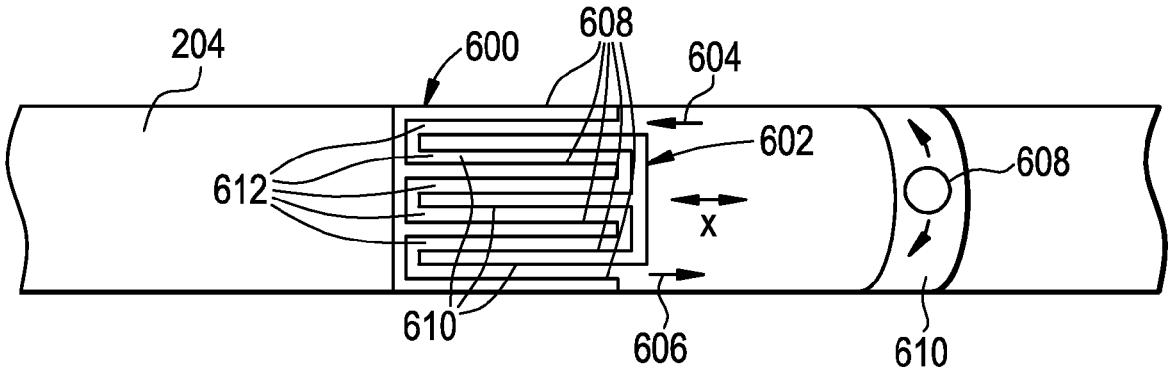
FIGS. 6A-6B illustrate portions of flow control devices, according to further embodiments, having structures with fingers to provide tortuous fluid paths having adjustable cross-sectional flow areas.
Figure 6B:
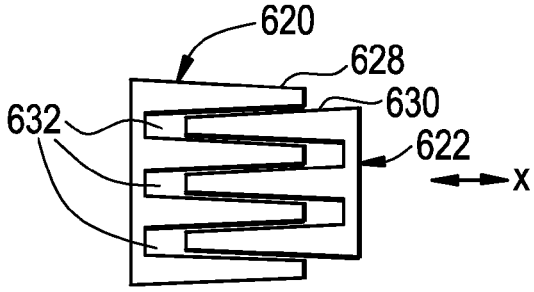

FIGS. 6A and 6B illustrate adjustment mechanisms according to other embodiments to define tortuous flow paths whose cross-sectional flow areas can be adjusted. In each of the embodiments of FIGS. 6A and 6B, the adjustment mechanism includes two cylindrically-shaped structures, where each cylindrically-shaped structure has fingers that interact with each other to form the tortuous flow path. For example, in FIG. 6A, a first cylindrically-shaped structure 600 has fingers 608, and a second cylindrically-shaped structure 602 has fingers 610. The fingers 608 and 610 are intertwined such that each finger 610 is provided between each pair of adjacent fingers 608. The intertwined fingers 608 and 610 define a tortuous flow path 612. Note that the cylindrically-shaped structures 600 and 602 are provided around the circumference of the pipe 204, as depicted in FIG. 6A. The cylindrically-shaped structures 600 and 602 are movable with respect to each other in the x direction (axial direction of the pipe 204) to adjust the cross-sectional flow area of the tortuous flow path 612. In one embodiment, the position of the cylindrically-shaped structure 600 is fixed, whereas the cylindrically-shaped structure 602 is movable in the x direction by movement of an actuation lug 608 that is movable along the circumference of the pipe 204 in a groove 610. The groove 610 is formed in the outer surface of the pipe 204. The actuation lug 608 and the groove 610 essentially form a cylindrical cam mechanism. An actuation mechanism (not shown) is coupled between the actuation lug 608 and the cylindrically-shaped structure 602 such that the movement of the lug 608 in the groove 610 causes axial movement of the cylindrically-shaped structure 602 (in the x direction). In another embodiment, the actuation lug 608 is rigidly connected to the cylindrically-shaped structure 602. The relative rotation between pipe 204 and the actuation lug 608 (together with the cylindrically-shaped structure 602 and 600) causes axial movement of the cylindrically-shaped structure 602 (in the x direction). There can be other embodiments based on the cylindrical cam mechanism for generating the relative axial movement between the cylindrically-shaped structures 600 and 602.

In operation, fluid flows into the tortuous flow path 612 at 604 and exits the tortuous flow path at 606. Relative movement of the cylindrically-shaped structures 600, 602 causes the cross-sectional flow area of the tortuous path to change such that the tortuous path's flow restriction between 604 and 606 changes accordingly.

The fingers 608 and 610 of the cylindrically-shaped structures 600 and 602 are generally rectangular in profile. In an alternative implementation, as depicted in FIG. 6B, cylindrically-shaped structures 620 and 622 (which are movable with respect to each other in the x direction or the axial direction of the pipe) have fingers 628 and 630, respectively. The fingers 628 and 630, rather than being rectangular in profile, have tapered shapes. The fingers 628 and 630 define a tortuous flow path 632.

Figure 7:
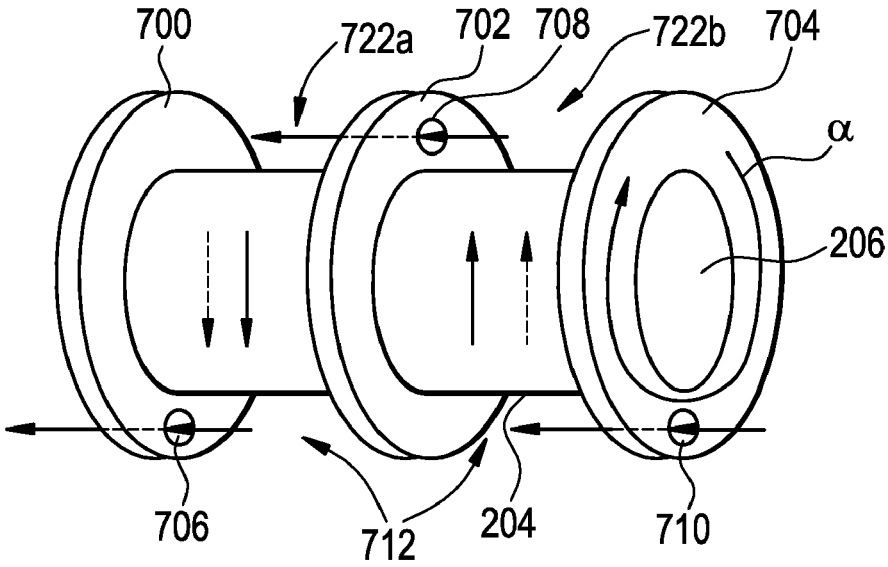
FIG. 7 illustrates a portion of a flow control device, according to a further embodiment, having movable disks to provide a tortuous fluid path having an adjustable cross-sectional flow area.

FIG. 7 illustrates yet another alternative embodiment, in which a tortuous flow path is defined by disks 700, 702, 704 that are movable with respect to each other in an axial direction (x direction) of the pipe 204. Although just three disks 700, 702, 704 are depicted, it is noted that additional disks can be employed in other implementations. The disks 700, 702, and 704 are ring-shaped with an inner, central hole such that the pipe 204 can fit through the inner holes of the disks 700, 702, and 704. Each of the disks 700, 702, and 704 has a respective port 706, 708, and 710 through which fluid can flow. The position of the ports on successive disks are varied such that the fluid flow follows a tortuous path. For example, in FIG. 7, the port 710 is located on a bottom side of the disk 704, the port 708 is located on a top side of the disk 702, and the port 706 is located on a bottom side of the disk 700. More generally, the ports in successive disks are offset with respect to each other in the angular direction a of the disks.

Each pair of successive disks 700, 702, 704 define a corresponding chamber 722A, 722B through which fluid flows from one port to another port. For example, as depicted in FIG. 7, fluid flows from port 710 through chamber 722B to port 708. Fluid from port 708 then passes through the chamber 722A to port 706. The combination of the ports 706, 708, 710 and chamber 722A, 722B form a tortuous path 712.

Figure 8A:
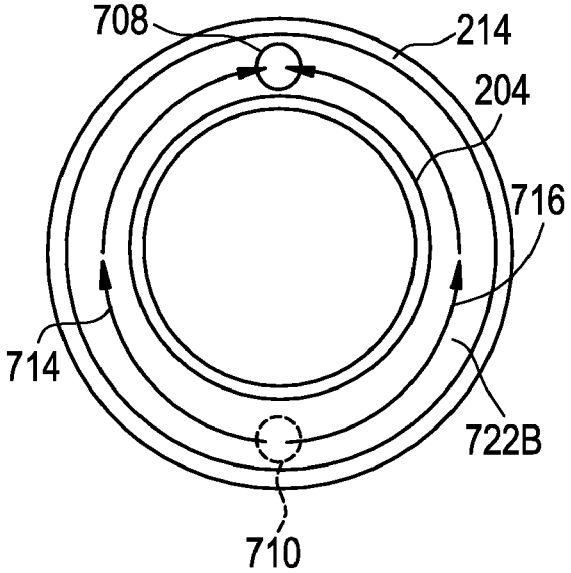
FIGS. 8A-8B are cross-sectional views of two alternative implementations of the flow control device depicted in FIG. 7.

FIG. 8A is cross-sectional view of a portion of the arrangement depicted in FIG. 7 to illustrate a fluid flow path through chamber 722B. In FIG. 8A, the outer sleeve 214 is depicted such that the chamber 722B is defined between the outer sleeve 214 and the pipe 204. Fluid enters into the chamber 722B through entry port 710, with the fluid following two symmetric paths 714 and 716 in the chamber 722B to arrive at the exit port 708 to flow to the next portion of the tortuous path 712.

Figure 8B:
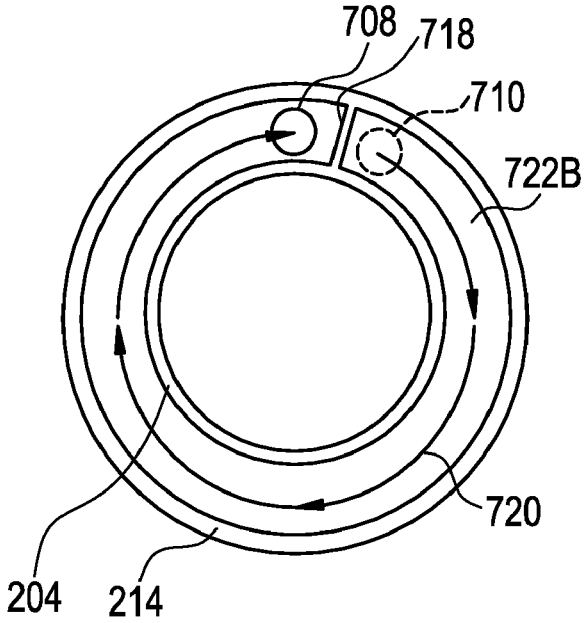

In an alternative embodiment, as depicted in FIG. 8B, a barrier 718 can be provided in the chamber 722B (and in other chambers) such that fluid flow has to follow a single path 720 in the chamber 722B. The barrier 718 extends radially between the outer sleeve 214 and the pipe 204.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for use in a wellbore, comprising:

a first flow conduit;

a second flow conduit;

a helical structure defining a tortuous fluid path proximate the first flow conduit, the tortuous fluid path to receive a flow of fluid from the first flow conduit and to direct the flow of fluid through the tortuous fluid path to the second flow conduit, wherein the tortuous fluid path is defined by at least first and second members of the structure, and the first and second members are movable with respect to each other to adjust a cross-sectional flow area of the tortuous fluid path, wherein different cross-sectional flow areas provided by different relative positions of the first and second members provide corresponding different flow restrictions for the flow of fluid through the tortuous fluid path from the first flow conduit to the second flow conduit; and an adjustment component that upon actuation moves along a direction to move the first and second members to a fixed position relative to each other to adjust the cross-sectional area of the tortuous fluid path.

2. The apparatus of claim 1, wherein the structure comprises a helical structure, and wherein the at least first and second members are different portions of the helical structure, and wherein the cross-sectional flow area of the tortuous fluid path provided by the helical structure is adjustable by compressing or uncompressing the helical structure.

3. The apparatus of claim 1, wherein the structure comprises a compressible structure that is configured to be compressed by movement of the adjustment component to adjust the cross-sectional flow area.

4. The apparatus of claim 3, wherein the adjustment component includes a rotatable collar that upon rotation causes the collar to move along the direction to compress or decompress the helical structure to adjust the cross-sectional flow area.

5. The apparatus of claim 1, wherein the flow conduit comprises a base pipe having an outer surface, and wherein the structure comprises a helical structure, the apparatus further comprising at least a sealing element between the helical structure and the outer surface of the base pipe.

6. The apparatus of claim 5, further comprising an outer sleeve to cover the helical structure, and at least another sealing element between the helical structure and the outer sleeve.

7. The apparatus of claim 1, further comprising a pipe and a screen around the pipe, wherein the structure is located proximate the screen to receive the flow of fluid that has passed through the screen and through an annulus between the screen and the pipe, wherein the first flow conduit includes the annulus, and wherein the second flow conduit includes an inner bore of the pipe.

8. The apparatus of claim 1, further comprising a pipe having an inner bore, the second flow conduit comprising the inner bore, the pipe having at least one port to allow fluid communication between the tortuous path and the second flow conduit.

9. A system for use in a well having plural zones, comprising:

plural flow control devices for placement in the corresponding zones, wherein each of at least some of the plural flow control devices comprises:

a structure defining a tortuous flow path, wherein the structure has members movable relative to each other to adjust a cross-sectional flow area of the tortuous flow path;

a pipe having at least one port and defining an inner bore, wherein the tortuous flow path is arranged to carry a flow of fluid from a flow conduit to the at least one port to allow the fluid to enter the inner bore of the pipe; and an outer sleeve, wherein the structure is between the pipe and the outer sleeve, and wherein the outer sleeve is sealingly contacted to an outer surface of each of the members of the structure.

10. The system of claim 9, wherein the at least some of the plural flow control devices have tortuous flow paths of different cross-sectional flow areas for providing different flow restriction through the corresponding at least some flow control devices in corresponding zones.

11. The system of claim 9, wherein the structure comprises a helical structure, and wherein the members comprise different portions of the helical structure, and wherein the cross-sectional flow area of the tortuous flow path provided by the helical structure is adjustable by compressing or uncompressing the helical structure.

12. The system of claim 9, wherein the flow control devices are adjustable using one of an intervention mechanism and an intervention-less mechanism to adjust corresponding cross-sectional flow areas.

13. A method for use in a well, comprising:

positioning a flow control device in the well, wherein the flow control device has a helical structure defining a tortuous flow path to define a flow restriction of the flow control device, and wherein the tortuous flow path is defined by members of a structure that are movable with respect to each other to adjust a cross-sectional flow area of the tortuous flow path;

moving the members relative to each other to adjust the cross-sectional flow area; and receiving a flow of fluid from an annulus outside the flow control device and directing the flow of fluid through the tortuous flow path before the flow of fluid reaches an inner bore of a pipe, wherein directing the flow of fluid through the tortuous path comprises directing the flow of fluid through the tortuous path defined by the structure positioned between the pipe and an outer sleeve that is sealingly engaged to an outer surface of each of the members of the structure.

14. The method of claim 13, wherein moving the members of the structure is performed prior to inserting the flow control device into the well.

15. The method of claim 13, wherein moving the members of the structure to adjust the cross-sectional flow area is performed after inserting the flow control device into the well.

16. The method of claim 13, wherein the flow control device is a first flow control device, the method further comprising:

positioning additional flow control devices each having a tortuous flow path to define a flow restriction of the corresponding additional flow control device, and wherein the tortuous flow path of the corresponding additional flow control device is defined by members of a respective structure that are movable with respect to each other to adjust a cross-sectional flow area of the corresponding tortuous flow path; and moving the members of each of the additional flow control devices to adjust corresponding cross-sectional flow areas of the respective additional flow control devices, wherein the cross-sectional flow areas of the first flow control device and the additional flow control devices are different for providing different flow restrictions.

17. An apparatus for use in a wellbore, comprising:

a first flow conduit;

a second flow conduit;

a structure defining a tortuous fluid path proximate the first flow conduit, the tortuous fluid path to receive a flow of fluid from the first flow conduit and to direct the flow of fluid through the tortuous fluid path to the second flow conduit, wherein the tortuous fluid path is defined by at least first and second members of the structure, and the first and second members are movable with respect to each other to adjust a cross-sectional flow area of the tortuous fluid path, wherein different cross-sectional flow areas provided by different relative positions of the first and second members provide corresponding different flow restrictions for the flow of fluid through the tortuous fluid path from the first flow conduit to the second flow conduit;

a pipe and a screen around the pipe, wherein the structure is located proximate the screen to receive the flow of fluid that has passed through the screen and through an annulus between the screen and the pipe, wherein the first flow conduit includes the annulus, and wherein the second flow conduit includes an inner bore of the pipe; and an outer sleeve, wherein the structure is mounted on the pipe, and wherein the outer sleeve covers the structure and is sealingly contacted to an outer surface of each of the first and second members.

18. The apparatus of claim 17, further comprising a rotatable member rotatably mounted to the pipe, wherein rotation of the rotatable member causes axial movement of the rotatable member to cause corresponding relative axial movement of the first and second members of the structure to adjust the cross-sectional flow area.

19. The apparatus of claim 18, wherein the structure is a helical, compressible structure.

20. An apparatus for use in a wellbore, comprising:

a first flow conduit;

a second flow conduit;

a structure defining a tortuous fluid path proximate the first flow conduit, the tortuous fluid path to receive a flow of fluid from the first flow conduit and to direct the flow of fluid through the tortuous fluid path to the second flow conduit, wherein the tortuous fluid path is defined by at least first and second members of the structure, and the first and second members are movable with respect to each other to adjust a cross-sectional flow area of the tortuous fluid path, wherein different cross-sectional flow areas provided by different relative positions of the first and second members provide corresponding different flow restrictions for the flow of fluid through the tortuous fluid path from the first flow conduit to the second flow conduit;

a pipe having an inner bore, the second flow conduit comprising the inner bore, the pipe having at least one port to allow fluid communication between the tortuous path and the second flow conduit; and an outer sleeve, wherein the structure is mounted on the pipe, and wherein the outer sleeve covers the structure and is sealingly contacted to an outer surface of each of the first and second members.

* * * * *